US005095557A

United States Patent [19]

Keyes

[11] Patent Number: 5,095,557

[45] Date of Patent: Mar. 17, 1992

[54] POOL COVER ASSEMBLY

[76] Inventor: Ken Keyes, 4112 W. Vienna Rd., Clio, Mich. 48420

[21] Appl. No.: 604,222

[22] Filed: Oct. 29, 1990

[51] Int. Cl.[5] ..... E04H 4/08

[52] U.S. Cl. ..... 4/503; 4/498

[58] Field of Search ..... 4/498, 503; 220/320, 220/321, 216

[56] References Cited

U.S. PATENT DOCUMENTS

| | | | |
|---|---|---|---|
| 2,146,190 | 2/1939 | Luke | 220/320 |
| 2,211,958 | 8/1940 | Mahaffey | 220/216 |
| 2,870,455 | 1/1959 | Reeves | 4/498 |
| 2,884,156 | 4/1959 | Graham et al. | 4/498 |
| 3,293,665 | 12/1966 | Langer | 4/503 |
| 3,344,440 | 10/1967 | Langer . | |
| 3,354,472 | 11/1967 | Steinbeck | 4/503 |
| 3,355,745 | 12/1967 | Jannuzzi | 4/503 |
| 3,391,410 | 7/1968 | Melberg | 4/503 |
| 3,534,412 | 10/1970 | Crook . | |
| 3,940,809 | 3/1976 | Hughes . | |
| 4,011,607 | 3/1977 | Davidoff | 4/503 |
| 4,599,753 | 7/1986 | Goodman | 4/503 |
| 4,847,925 | 7/1989 | Perry | 4/503 |

FOREIGN PATENT DOCUMENTS

| | | | |
|---|---|---|---|
| 0648132 | 3/1933 | Australia | 220/320 |
| 1109374 | 9/1955 | France | 220/321 |
| 1116144 | 1/1956 | France | 220/320 |
| 7807740 | 1/1979 | Netherlands | 220/320 |
| 0212309 | 3/1938 | Switzerland | 220/320 |

*Primary Examiner*—William A. Cuchlinski, Jr.
*Assistant Examiner*—John L. Beres
*Attorney, Agent, or Firm*—Gifford, Groh, Sprinkle, Patmore and Anderson

[57] ABSTRACT

A cover assembly for a swimming pool is provided for winter protection of the pool and the water contained therein. The assembly includes a cover and an adjustable ring assembly for securing the cover against the inner side of the pool's peripheral wall. The ring assembly may be of one-piece construction or may be multiply-segmented. In either embodiment a ring size linear adjusting assembly is provided to firmly position the ring assembly to the inner side of the peripheral wall. The adjusting assembly may either comprise a pair of adjustably interlocking segments or a ratchet mechanism.

17 Claims, 2 Drawing Sheets

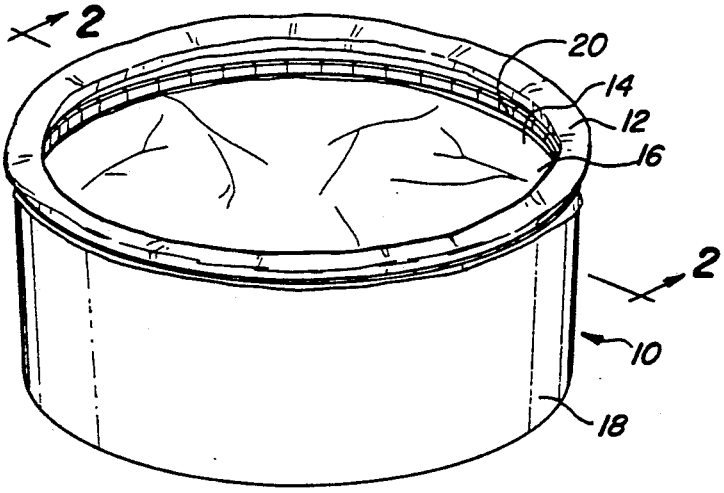
Fig-1
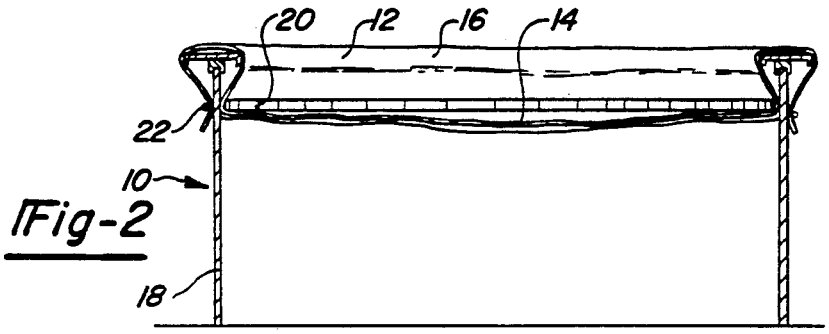
Fig-2
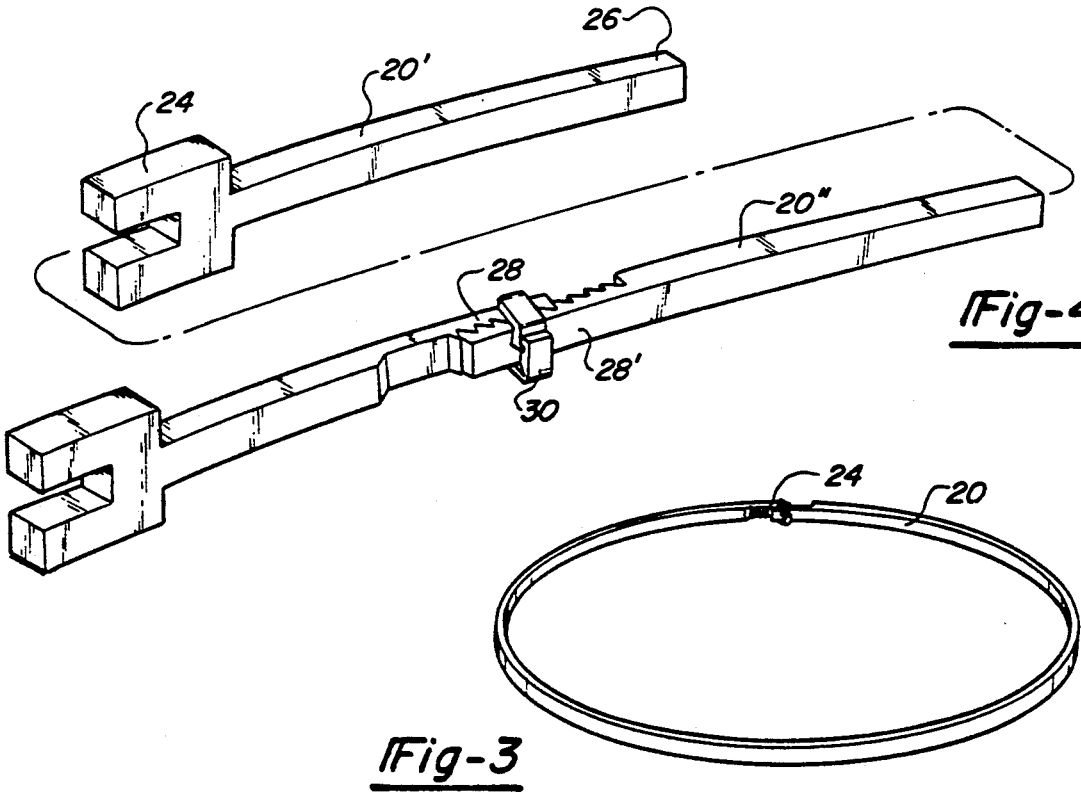
Fig-4
Fig-3

POOL COVER ASSEMBLY

BACKGROUND OF THE INVENTION

I. Field of the Invention

The present invention relates generally to protective covers for pools. More particularly, the present invention relates to a cover for a pool that is particularly suitable for protection during the winter. The cover assembly includes a cover and an inner ring assembly for adhering the cover to the inner side of the pool's peripheral wall.

II. Description of the Relevent Art

The popularity of home swimming pools has risen dramatically in the past two decades. This increase in interest in swimming pools is largely due to the utility of these pools for recreation, relaxation and exercise.

However, swimming pools suffer a general disadvantage in that they require a considerable amount of maintenance, particularly during the summertime when cleanliness and balanced chemical composition is necessary.

Maintenance of swimming pools is a year-round activity. During the winter months in colder climates, a pool owner has substantially two choices as to the maintenance of the pool. First, the owner can drain the pool, an effective but impractical and costly exercise. Second, the owner can cover the pool. By providing a cover, debris and animals are kept out of the water during the cold season when the pool water is not regularly used or cleaned.

Known covers are composed of a heavy-gauge plastic sheet that is provided over the top of the pool. If the pool is a conventional above-ground type, then a cable, band or similar holding assembly is fitted about the outer side of the pool wall with the cover material being held between the wall and the holding assembly. On the other hand, in-ground pools may also use plastic covers, but alternatively utilize an anchor assembly to anchor the cover either to the ground or to the walls about the pool.

These known procedures have several disadvantages. First, suspending the cover taught across the upper ledge of the pool requires considerable labor, as the weight of the material tends to cause the cover to sag.

Second, and relatedly, because conventional covers are suspended over the water of the pool from the ledge, the cover is weighted down by collected snow and ice. This damages the integrity of the cover material which is forced to stretch in response to the added weight.

Third, and more importantly, in high wind, the conventional cover tends to billow upwards, partly due to a drop in ambient air pressure, partly due to a vacuum effect. Repeated billowing causes premature wear on the cover and may cause ripping and shredding.

Accordingly, the prior approaches to solving the problem of providing a cover for a pool and the like have resulted in producing a troublesome cover that only minimally achieves its purpose.

SUMMARY OF THE PRESENT INVENTION

The present invention provides a cover assembly for a swimming pool or a similar pool of water or other liquid. The cover assembly is specifically directed at being used for providing winter protection of the pool and the water contained therein. Naturally, the cover assembly of the present invention may also be used for providing protection during other seasons of the year, where it is desired to protect the water from debris and the like.

The assembly includes a cover and an adjustable ring assembly for securing the cover against the inner side of pool's peripheral wall. The cover is composed preferably of a polymerized material such as a plastic, vinyl or a similar resiliant material. The cover includes a water covering portion which preferably lies directly on top of the water of the pool and an upright overlapping portion which is provided substantially perpendicularly with respect to the water covering portion. The upright portion may or may not overlap the ledge of the pool, as this depends on the preference of the user and the construction of the pool. If the overlapping portion overlaps the ledge of the pool and hangs towards the outside of the peripheral wall, an outer ring is provided to adhere the overlapping portion against the outer side of the peripheral wall. Naturally, the assembly according to this embodiment is directed at above-ground pools. In the case of in-ground pools, the outer ring is unnecessary. In any event, the outer ring, when employed, may comprise a cable or similar device for pressing the overlapping portion against the outer side of the peripheral wall.

The ring assembly, fittable against the inner side of the peripheral wall, is preferably disposed on the overlapping portion of the cover approximately along the seam between the overlapping portion and the water covering portion. In this way the cover will best resist billowing and will further minimize damage caused by debris including the weight of snow, ice, and the like. The assembly may be of one-piece construction thereby comprising a single expandable ring composed of a flexible material adaptable to the particular shape of the inner side of the peripheral wall. Conversely, the ring assembly may be composed of a plurality of interlocking segments, whereby each segment is of a preselected length.

In either embodiment, at one end of the ring (if a single piece) or of each segment (if a multiple-segment construction), there is provided a U-shaped female receiving end. At the other end of the ring or segment is provided a male portion which is removably insertable into the female end. In either embodiment, the male end may be selectively cut so as to provide a close fit of the ring assembly to a very close tolerance as may be necessary for proper fitting against the inner side of the peripheral wall.

For course adjustment of the multiple-segment embodiment, the ring or segments may be trimmed or one or more segments may be left out of the inner ring before it is positioned within the pool. These segments may themselves be of different lengths as provided by the manufacturer, thereby reducing the amount that the user has to cut from the male end and thereby minimize wasted material. Naturally, other methods of providing interlocking of one end to the other may be utilized as the U-shaped female end and its corresponding male end are considered only one possible choice of other, similar alternatives.

Once situated within the pool and placed against the inner side of the peripheral wall with the upright portion of the cover fitted therebetween, a fine adjustment of the inner ring is necessary. This fine adjustment is done after the single ring or the individual segment is cut or otherwise fitted coursely into position.

To provide for fine adjustment, an adjusting assembly is provided. The assembly is provided on either the ring in the single-ring embodiment or is provided on one or more segments in a multiple-segment embodiment. In either situation, the purpose of the ring adjusting assembly is to expand the single ring or the single segment so as to force the inner ring firmly against the inner side of the peripheral wall, thereby providing a tight fit so as to prevent shifting of the ring in high winds or in other inclement weather.

Although there may be other methods of providing adjustment, two are provided herein. In either embodiment, the single ring or segment is selectively split at a preselected point whereby the split produces two ends.

In the first embodiment, the two ends are selectively interattachable with each other. A multiple scale or notch system is used which provides for the lengthening of the ring by moving one portion of the split ring or segment in one direction or the other and thereafter interlocking the two halves against each other in the respective notches provided in each interconnecting end.

In the alternative embodiment, a ratchet mechanism is provided at a selected position on either the single ring or on a single segment. According to this mechanism, a gear is provided on one portion of the ring or segment and a rack is provided on the other portion of the ring or segment whereby the rack is coactable with the gear. A pawl is interconnected with either the rack or the gear to prevent the linearly expanded ring or segment from moving to a reduced size once adjusted to an expanded size. To adjust the ratchet mechanism, a socket wrench or similar tool may be used.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the prefered embodiments of the present invention when read in conjunction with accompanying drawing, in which like reference characters refer to like parts throughout the views, and in which:

FIG. 1 is a peripheral view of a swimming pool showing the cover according to the present invention in place thereover;

FIG. 2 is a view taking along line 2—2 of FIG. 1 illustrating the cover in place relative to the peripheral wall of the pool and the liquid contained therein;

FIG. 3 illustrates a segmented version of the inner ring, the segmented version being provided with a pair of notched, interattaching adjustable ends for selectively expanding the length of the segment;

FIG. 4 illustrates an alternate embodiment of the inner ring in its single-piece construction;

DETAILED DESCRIPTION OF PREFERRED EMBODIMENTS OF THE PRESENT INVENTION

Figure 5:
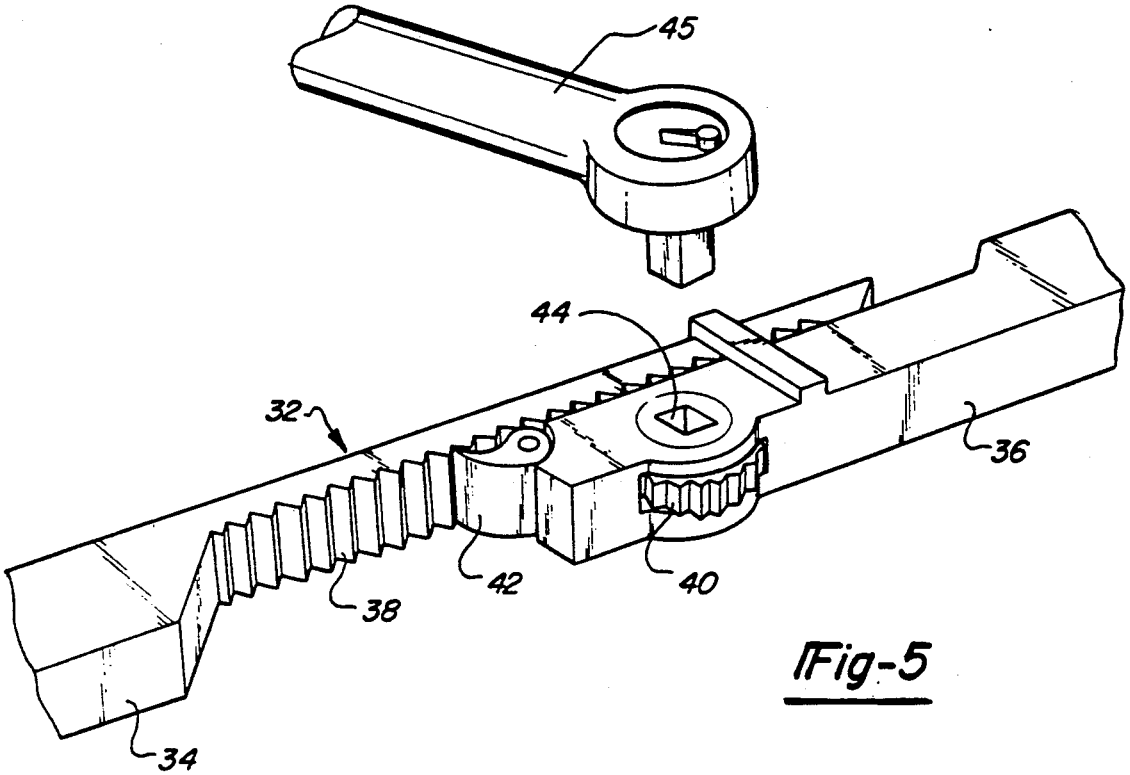
FIG. 5 illustrates a ratcheting mechanism for expanding a segment.

The drawing discloses the preferred embodiments of the present invention. While the configurations according the illustrated embodiments are preferred, it is envisioned that alternate configurations of the present invention may be adopted without deviating from the invention as portrayed. The preferred embodiments are discussed hereafter.

Referring to FIG. 1, there is illustrated a pool, generally indicated as 10. The pool 10 is preferably a swimming pool, but may be any fluid-containing structure requiring protection. The pool 10 is illustrated as having a round shape, but it should be understood that the pool may alternatively be kidney-shaped, elongated, square-shaped, or rectangularly-shaped.

The pool has situated thereupon an overlapping portion 12. The overlapping portion 12 is provided generally about the periphery of the pool 10. Interconnected with the overlapping portion 12 is the base portion 14 which rests upon the water of the pool 10. The overlapping portion 12 and the base portion 14 comprise the pool cover 16, which is preferably a one-piece unit. Preferably, the cover 16 is constructed of a polymerized material such as a plastic or a vinyl.

The pool 10 includes a peripheral wall 18. The peripheral wall 18 is present whether the pool 10 is of the above-ground type as illustrated or is of the in-ground type (not shown).

The overlapping portion 12 of the cover 16 is pressed against the inner side of the peripheral wall 18 by means of an inner band 20.

Referring to FIG. 2, a sectional view of FIG. 1 is illustrated. This view better illustrates the component parts of the cover 16 and the band 20 relative to the pool 10.

As illustrated herein, the overlapping portion 12 is suspended over the top of the peripheral wall 18 at an approximate point where it is adhered to the outer side of the peripheral wall 18 by an outer band or cable 22. The cable 22 is provided to assist in keeping an air current from finding its way under the cover 16. Of course, when the cover 16 of the present invention is fitted to an in-ground pool, the cable 22 is not used unless the pool's construction so allows.

Referring to FIGS. 3 and 4, an embodiment of the inner band 20 is composed of a single, one-piece band having a linear expansion and locking assembly with two ends 24 and 26 provided thereon. The locking assembly allows the user to fit the band 20 loosely in place at approximately the seam between the overlapping portion 12 and the base portion 14 (as illustrated in FIG. 2). Once in place, the band 20 is linearly expanded by the locking assembly against the overlapping portion 12 so as to force it against the inner side of the peripheral wall 18 at approximately water level.

An alternative embodiment of the one-piece band 20 is the segmented band, as illustrated in FIG. 4. The segmented band is composed of a plurality of segments 20'. Each segment 20' includes a pair of interlocking ends 24, 26. As illustrated, the end 24 is a U-shaped, female section and the end 26 is a male section. The illustrated sections are intended to be interlocked with each other, end to end. The illustrated ends 24, 26 are therefore only suggestive with the significant characteristic being that each segment 20' is interattachable with the next.

The segments 20' may be provided in various lengths depending upon the size of the pool. For example, the segments 20' may be provided in six-, eight-, or ten-foot lengths. In a typical application in a twenty-four foot diameter pool, the circumference of the pool may vary slightly between seventy-two feet and seventy-eight feet. The appropriate combination of segments 20' of various lengths is made. To make the segments 20' more exact fitting, the male section 26 of a single segment 20' may be shortened by cutting. Preferably the segment is composed of a polymerized material, thereby easily accommodating such adjustment.

As with the single-piece embodiment of FIG. 3, once the segments 20' are connected to form a unified band, the collective band should be linearly expanded to force the upright overlapping portion 12 snugly against the inner side of the peripheral wall 18. This measure may be accomplished either by the notched system illustrated in FIG. 4, or by the ratchet systems of FIGS. 5 and 6.

FIG. 4 shows a pair of multi-notched, interlocking ends 28, 28' defined on a segment 20''. The ends 28, 28' are interlockable at various positions whereby the segment 20'' may be shortened or lengthened to obtain optimum fit. Once fitted to its proper length, a locking cap 30 is provided to hold the ends 28, 28' together.

Figure 6:
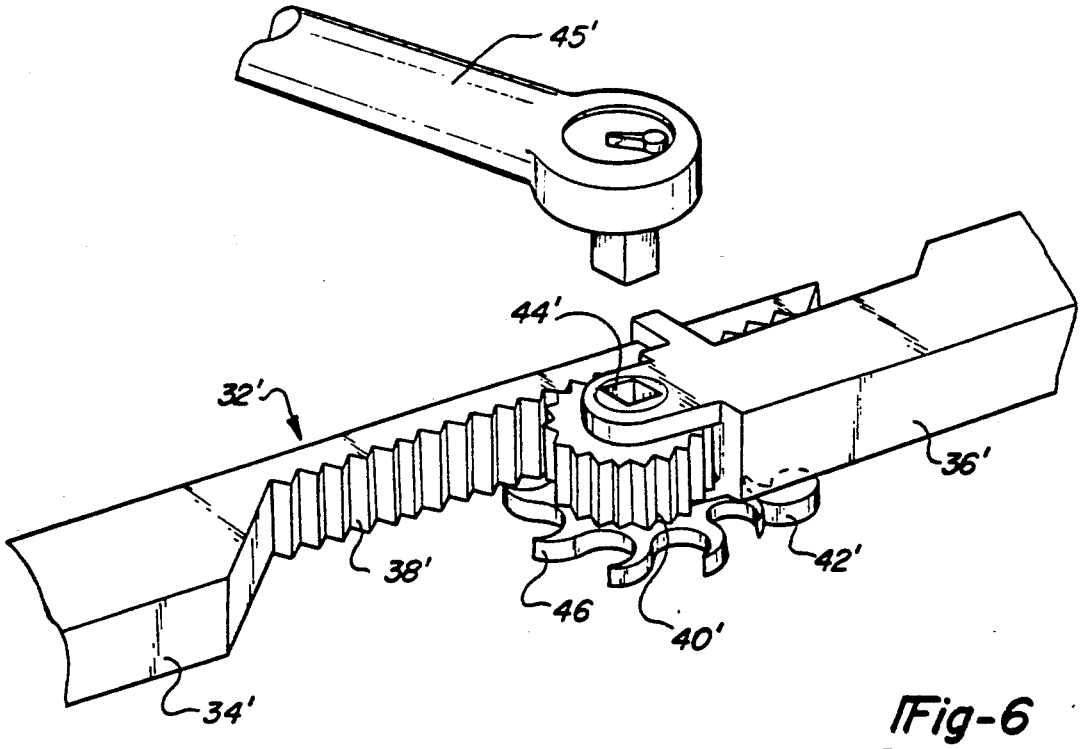
FIG. 6 illustrates an alternate ratcheting mechanism for expanding a segment.

Alternatively, a ratcheting mechanism may be provided as shown in FIGS. 5 and 6.

Referring first to FIG. 5, a divided segment 32 includes a first half 34 and a second half 36. A ratcheting assembly is provided and comprises a rack 38 defined upon the first half 34 and a coacting gear 40 fitted to the second half 36. A spring-loaded pawl 42 is provided engageably against the rack 38. A ½ or ¾ socket 44 is preferably defined in the top of the gear 40 for removably receiving a conventional ratchet 45.

As an alternative, according to FIG. 6, a divided segment 32' includes a first half 34' and a second half 36'. Like the segment 32 described above with respect to FIG. 5, the ratcheting assembly comprises a rack 38' and a coacting gear 40'. A spring-loaded pawl 42' is provided to engage a wheel 46. A ½ or ¾ socket 44' is defined at the top of the gear 40' for removably receiving a conventional ratchet 45'.

Whether employing the linear-adjusting embodiment of FIGS. 4, 5 or 6, one or more segments may be selectively used as required and dictated by such variables as pool size, wall shape, and the like.

Having described my invention, however, many modifications thereto will become apparent to those skilled in the art to which it pertains without deviation from the spirit of the invention as defined by the scope of the appended claims.

I claim:

1. A cover assembly for a swimming pool and the like, said pool having a peripheral wall, said peripheral wall having an inner side and an outer side, said assembly comprising:

a cover; and means for removably and adjustably adhering said cover to said inner side of said peripheral wall, said means comprising an adjustably expandable ring assembly, said ring having two ends and means for adjustably locking said ends together.

2. The cover assembly according to claim 1 wherein said means for locking comprises two or more releasably interlocking segments.

3. The cover assembly according to claim 2 wherein each of said segments includes a male end and a female end, said female end defining a U-shaped segment for releasably receiving said male end.

4. The cover assembly according to claim 3 wherein at least one of said two or more releasably interlocking segments includes means for adjusting the length of said at least one of said two or more releasably interlocking segments.

5. The cover assembly according to claim 5 wherein said means for adjusting comprises a first interlocking end and a second interlocking end, said interlocking-ends being interlockable in a selected one of a plurality of positions whereby the length of said at least one segment may be selectively linearly adjusted.

6. The cover assembly according to claim 4 wherein said means for adjusting comprises a ratchet mechanism.

7. The cover assembly according to claim 1 wherein said cover comprises a water-covering base portion and an overlapping portion, said overlapping portion being interattached with said base portion at an attachment point peripherally defined about said base portion;

said overlapping portion extending along said inner side of said peripheral wall.

8. The cover assembly according to claim 7 wherein said ring assembly is removably fittable along said attachment point so as to substantially press said overlapping portion against said inner side of said peripheral wall.

9. The cover assembly according to claim 8 wherein said overlapping portion overlaps said outer side of said peripheral wall.

10. The cover assembly according to claim 9 further including means for adhering said overlapping portion to said outer side of said peripheral wall.

11. A cover assembly for a swimming pool and the like, said pool having a peripheral wall, said peripheral wall having an inner side and an outer side, said assembly comprising:

a cover; and means for removably and adjustably adhering said cover to said inner side of said peripheral wall;

said means for removably and adjustably adhering being composed of a plurality of releasably interlocking segments.

12. The cover assembly according to claim 11 further including means for removably adhering said cover to said outer side of said peripheral wall.

13. The cover assembly according to claim 11 wherein at least one of said segments includes means for adjusting the length of said segment.

14. The cover assembly according to claim 13 wherein said means for adjusting comprises a ratchet mechanism.

15. In combination with a pool structure containing a fluid wherein said pool structure has an inner periphery:

a cover having a water-covering base portion and an interrelated inner periphery-contacting portion; and means for adjustably, removably and sealingly adhering said inner periphery-contacting portion to the inner periphery of the pool structure, said adhering means comprising an elongated member having two ends and means for adjustably locking said ends together.

16. The combination according to claim 15 wherein said locking means comprises a plurality of releasably interlocking segments, each of said segments having a length.

17. The combination according to claim 16 wherein at least one of said plurality of segments includes a linear adjustment assembly for adjusting said length of said segment.

* * * * *